US009283493B1

(12) United States Patent
Bernard

(10) Patent No.: US 9,283,493 B1
(45) Date of Patent: Mar. 15, 2016

(54) CRANK-N-FOAM SYSTEMS

(71) Applicant: Elaine Bernard, Culver City, CA (US)

(72) Inventor: Elaine Bernard, Culver City, CA (US)

( * ) Notice: Subject to any disclaimer, the term of this patent is extended or adjusted under 35 U.S.C. 154(b) by 0 days.

(21) Appl. No.: 14/243,717

(22) Filed: Apr. 2, 2014

Related U.S. Application Data

(60) Provisional application No. 61/810,207, filed on Apr. 9, 2013.

(51) Int. Cl.
*A63H 33/28* (2006.01)

(52) U.S. Cl.
CPC ..... *A63H 33/28* (2013.01)

(58) Field of Classification Search
CPC ..... A63H 33/28; F41B 9/00; F41B 9/0096; F41B 9/0006; F41B 9/0003
USPC ..... 446/15–21, 220
See application file for complete search history.

(56) References Cited

U.S. PATENT DOCUMENTS

| | | | | |
|---|---|---|---|---|
| 3,365,838 | A | 1/1968 | Butler | |
| 4,733,799 | A | 3/1988 | Wiskur | |
| 5,730,325 | A | 3/1998 | Cheung | |
| 5,829,635 | A | 11/1998 | Brovelli | |
| 2005/0098577 | A1 * | 5/2005 | Huy et al. | 222/79 |
| 2010/0209281 | A1 | 8/2010 | Jackson et al. | |
| 2012/0220184 | A1 * | 8/2012 | Orem et al. | 446/16 |
| 2012/0270462 | A1 * | 10/2012 | Lo | 446/15 |

* cited by examiner

*Primary Examiner* — Gene Kim
*Assistant Examiner* — Rayshun Peng
(74) *Attorney, Agent, or Firm* — RG Patent Consulting, LLC; Rachel Gilboy

(57) ABSTRACT

The crank-n-foam is a toy gun that is able to propel bubbles and a foamy water mixture from the barrel after rapidly cranking a handle on the reservoir shell, which builds foam and pressure within the reservoir, and then releasing the foam and bubbles by opening a manual switch on the barrel shell. The toy provides safe entertainment for the user.

18 Claims, 5 Drawing Sheets

CRANK-N-FOAM SYSTEMS

CROSS-REFERENCE TO RELATED APPLICATION

The present application is related to and claims priority from prior provisional application Ser. No. 61/810,207, filed Apr. 9, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of toys and more specifically relates to a toy gun, which is able to propel bubbles and a foamy water mixture from the barrel after a user rapidly cranks a handle on the reservoir shell to build foam and pressure, a crank-n-foam system.

2. Description of the Related Art

Many kids enjoy playing with water, and water guns during the summer to keep themselves cool. Toddlers and younger age children typically have sensitive skin, although many adults have sensitive skin as well. Most water guns today, however, shoot high-powered jets of water that can sting the skin when hit with that stream. Additionally, kids are always looking for new toys that offer a distinctive twist. A suitable solution is desirable.

Various attempts have been made to solve the above-mentioned problems such as those found in U.S. Pat. and Pub. Nos. 2005/0098577 to Gerhart Huy; 4,733,799 to Darrell Wiskur; and 2010/0209281 to James L. Jackson and Dean Kamen. This art is representative of water gun toys. None of the above inventions and patents, taken either singly or in combination, is seen to describe the invention as claimed.

Ideally, a toy bubble gun should provide ease of use and, yet would operate reliably and be manufactured at a modest expense. Thus, a need exists for a reliable crank-n-foam system to produce bubbles and foamy water to be propelled from a toy guns barrel after a user cranks a handle to produce the pressure needed, and to avoid the above-mentioned problems.

BRIEF SUMMARY OF THE INVENTION

In view of the foregoing disadvantages inherent in the known water gun toy art, the present invention provides a novel crank-n-foam system. The general purpose of the present invention, which will be described subsequently in greater detail, is to provide a toy gun, which will produce and dispel bubbles and foamy water from the barrel after a user cranks a handle to produce bubbles in the reservoir.

A crank-n-foam system is disclosed herein, in a preferred embodiment, comprising: a crank-n-foam assembly having a hand grip, a reservoir comprising a fill port, a hand crank, a pivot rod, an inner volume, a reservoir shell, and a series of paddles. It further comprises a barrel having a manual switch, an inner chamber, a barrel shell, and a chamber flap. The crank-n-foam assembly is manufactured with a durable plastic material, which makes it substantially corrosion resistant, and waterproof. The crank-n-foam assembly is a gun shaped toy, and the hand grip is suitable for gripping and holding the crank-n-foam assembly for use.

The reservoir comprises a fill port, a hand crank, a pivot rod, an inner volume, a reservoir shell, and a series of paddles. The fill port rotates counter clockwise to open the reservoir for filling, and subsequently rotates clockwise to close. The leak proof reservoir is preferably made with clear material to allow a user to know when agitation of the soap product is complete, and is able to contain a substantially pressurized soapy substance until dispelled by a user. The pivot rod is attached to a series of paddles within the inner volume, and passes through the reservoir shell, attaching to a hand crank, while remaining leak proof, via use of a seal. The hand crank facilitates rotation of the series of paddles within the reservoir, and is able to extend from either side of the reservoir, for left and right-handed users.

The pivot rod and series of paddles are manufactured with a durable material for longevity of use, and comprise a rigid, durable material able to maintain its original shape and properties while submerged in a soapy substance for extended periods of time. When the hand crank is turned about its axis, the series of paddles rotate in a likewise manner within the inner volume, and are able to be rotated both clockwise and counter clockwise to agitate the soap product for use as needed. Each paddle of the series of paddles has holes to facilitate agitation of the soap product while rapidly turning the hand crank.

The barrel comprises the manual switch, the inner chamber, the barrel shell, and the chamber flap in combination. The manual switch is attached to the chamber flap within the inner chamber, and is able to rotate the chamber flap to close, and effectively seal the inner chamber from the reservoir, as needed to build pressure in the reservoir. The manual switch is then able to rotate the chamber flap upwardly to dispense foam and bubbles from the inner chamber. The crank-n-foam assembly is able to be filled with a soap product via the fill port on the reservoir, and then a user is able to manually turn the hand crank in a rapid manner, with the chamber flap in a closed position, thereby creating a foamy, substantially pressurized solution within the reservoir. The user is then able to move the chamber flap to an open position, thereby dispelling bubbles and foamy solution from the inner chamber in a rapid fashion.

The present invention holds significant improvements and serves as a crank-n-foam system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, crank-n-foam system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an entertainment device and more particularly to a toy gun which propels bubbles and a foamy water solution from the barrel as used to improve the safety and enjoyment of toy water gun play.

Generally speaking, the crank-n-foam is a toy gun that is able to propel bubbles and a foamy water mixture from the barrel after rapidly cranking a handle on the reservoir shell to build foam and pressure to be used for entertaining purposes.

Figure 1:
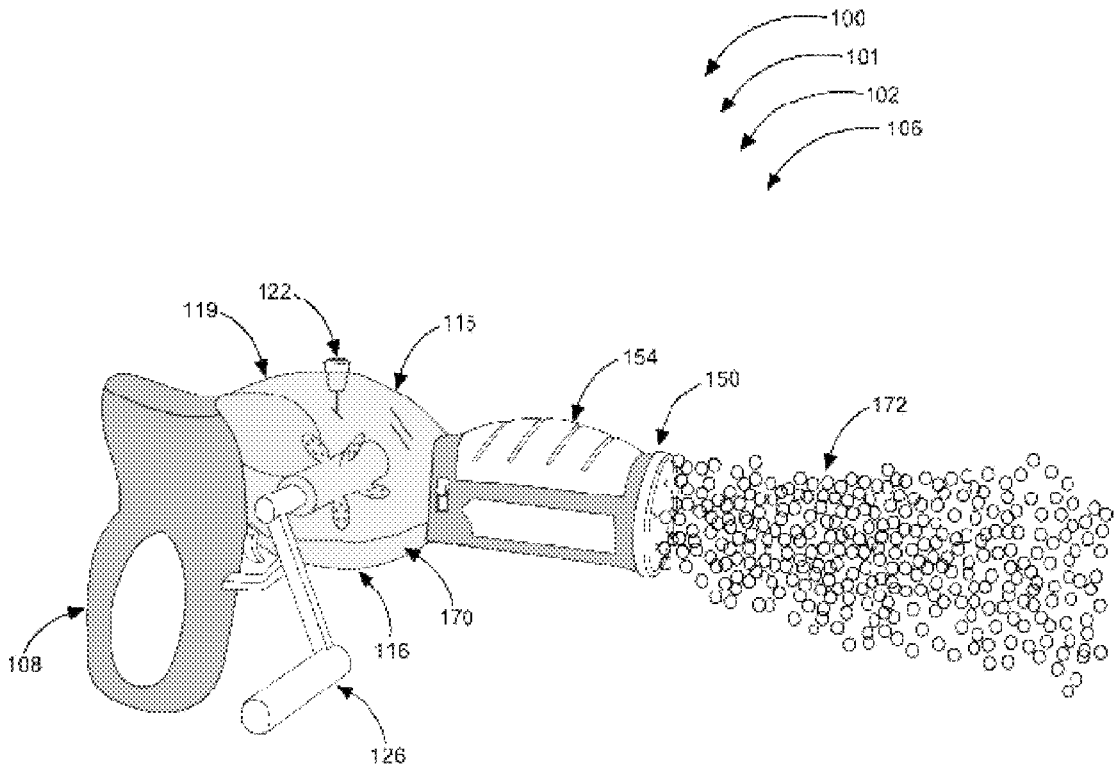
FIG. 1 shows a perspective view illustrating a crank-n-foam system in an in-use condition according to an embodiment of the present invention.

Referring now to the drawings by numerals of reference there is shown in FIG. 1, a perspective view illustrating an in-use condition 101 of crank-n-foam system 100 according to an embodiment of the present invention.

Crank-n-foam system 100 in a preferred embodiment, comprises: crank-n-foam assembly 102 having hand grip 108, reservoir 115 comprising fill port 122, hand crank 126, pivot rod 130, inner volume 117, reservoir shell 119, and series of paddles 140. The present invention further comprises barrel 150 having manual switch 156, inner chamber 152, barrel shell 154, and chamber flap 160. Crank-n-foam assembly 102 is manufactured with durable plastic material 104, which makes it substantially corrosion resistant, and waterproof. Crank-n-foam assembly 102 is gun shaped toy 106, and hand grip 108 is suitable for gripping and holding crank-n-foam assembly 102 for use.

Figure 2:
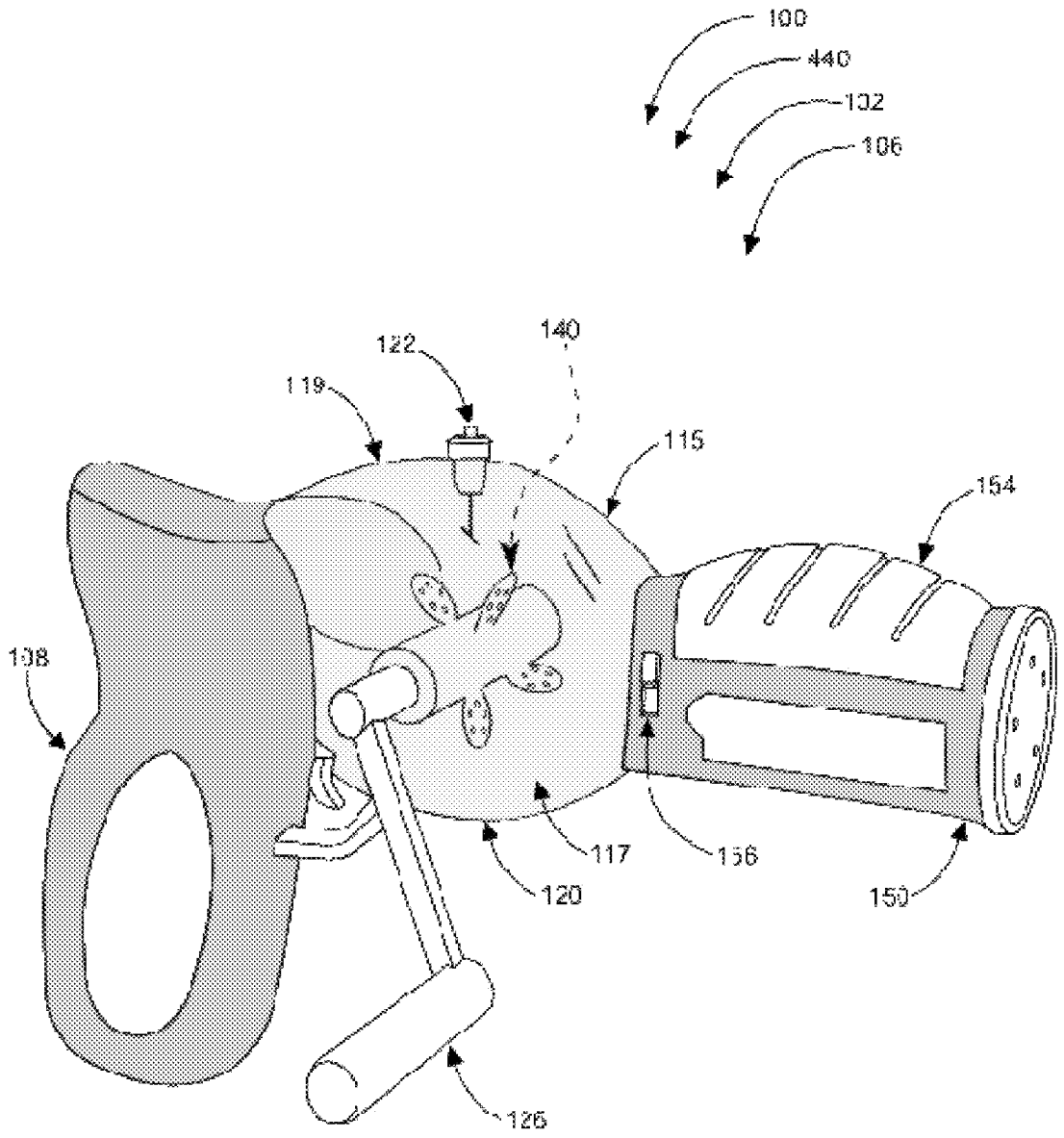
FIG. 2 is a perspective view illustrating the crank-n-foam assembly according to an embodiment of the present invention of FIG. 1.

Referring now to FIG. 2, an exploded view illustrating crank-n-foam assembly 102 according to an embodiment of the present invention.

Fill port 122 rotates counter clockwise to open reservoir 115 for filling, and subsequently rotates clockwise to close. Leak proof reservoir 116 is made with a clear material 120 to allow a user to know when agitation of soap product 170 is complete, and is able to contain a substantially pressurized soapy substance until dispelled by a user, as shown in FIG. 1. Pivot rod 130 is attached to series of paddles 140 within inner volume 117, and passes through reservoir shell 119, attaching to hand crank 126, while remaining leak proof, via use of seal 121. Hand crank 126 facilitates rotation of series of paddles 140 within reservoir 115, and is able to extend from either side of reservoir 115, for left and right-handed users.

Figure 3:
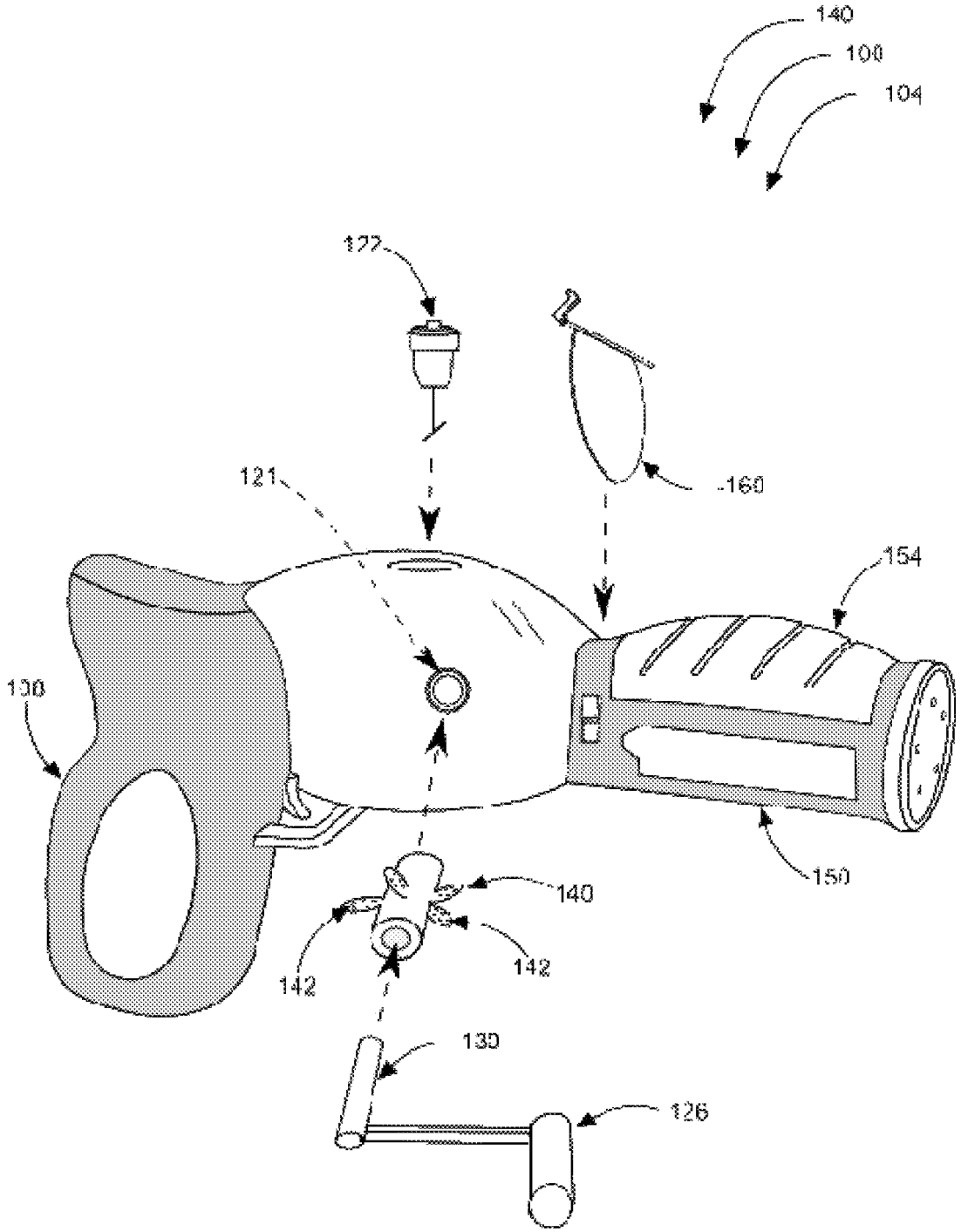
FIG. 3 is an exploded view illustrating the crank-n-foam assembly according to an embodiment of the present invention of FIG. 1.

Referring now to FIG. 3, a perspective view illustrating crank-n-foam assembly 102 according to an embodiment of the present invention.

Pivot rod 130 and series of paddles 140 are manufactured with a durable, and rigid material for longevity of use, which allow them to maintain their original shape and properties while submerged in a soapy substance for extended periods of time. When hand crank 126 is turned about its axis, series of paddles 140 rotate in a likewise manner within inner volume 117, and are able to be rotated both clockwise and counter clockwise to agitate soap product 170 for use as needed. Each paddle of the series of paddles 140 has holes 142 to facilitate agitation of soap product 170 while rapidly turning hand crank 126. The present invention can be easily cleaned after use.

Figure 4A:
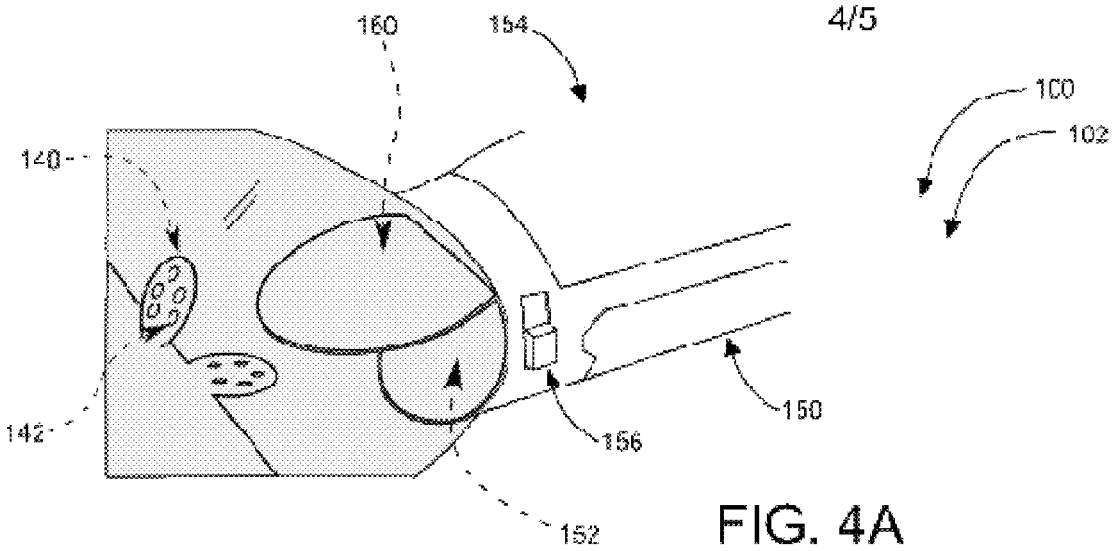
FIG. 4A is perspective view illustrating an inner chamber and chamber flap of the crank-n-foam assembly according to an embodiment of the present invention of FIG. 1.
Figure 4B:
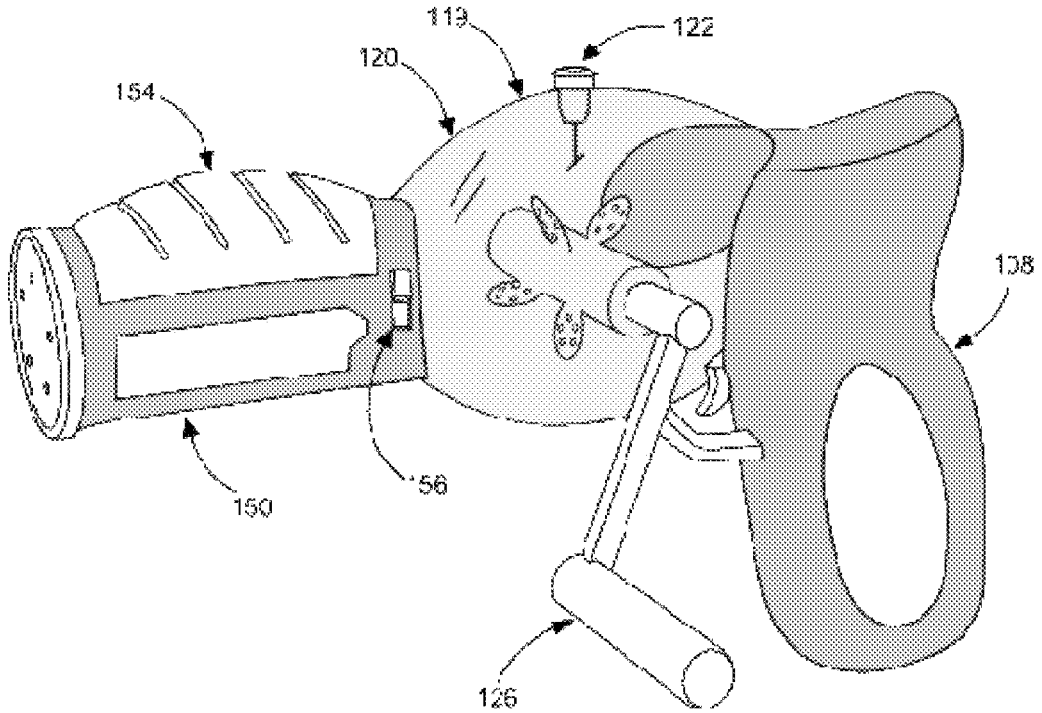
FIG. 4B is another perspective view illustrating the crank-n-foam assembly according to an embodiment of the present invention of FIG. 1.

Referring now to FIGS. 4A and 4B, showing a side view illustrating inner chamber 152 and chamber flap 160 of crank-n-foam assembly 102, and a perspective view respectively, according to an embodiment of the present invention.

Barrel 150 comprises manual switch 156, inner chamber 152, barrel shell 154, and chamber flap 160 in combination. Manual switch 156 is attached to chamber flap 160 within inner chamber 152, and is able to rotate chamber flap 160 to close, and effectively seal inner chamber 152 from reservoir 115, as needed to build pressure in reservoir 115. Manual switch 156 is then able to rotate chamber flap 160 upwardly to dispense foam and bubbles the inner chamber 152. Crank-n-foam assembly 102 is able to be filled with soap product 170 via fill port 122 on reservoir 115, and then a user is able to manually turn hand crank 126 in a rapid manner, with chamber flap 160 in a closed position, thereby creating a foamy, substantially pressurized solution within reservoir 115. A user is then able to move chamber flap 160 to an open position (as shown in FIG. 1), thereby dispelling bubbles and foamy solution 172 from inner chamber 152 in a rapid fashion.

Crank-n-foam system 100 may be sold as kit 440 comprising the following parts: at least one crank-n-foam assembly 102 having: at least one hand grip 108; at least one reservoir 115 with hand crank 126 and series of paddles 140, at least one barrel 150 with manual switch 156 and chamber flap 160; and at least one set of user instructions for use. Crank-n-foam system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different reservoir combinations, parts may be sold separately, etc., may be sufficient.

Figure 5:
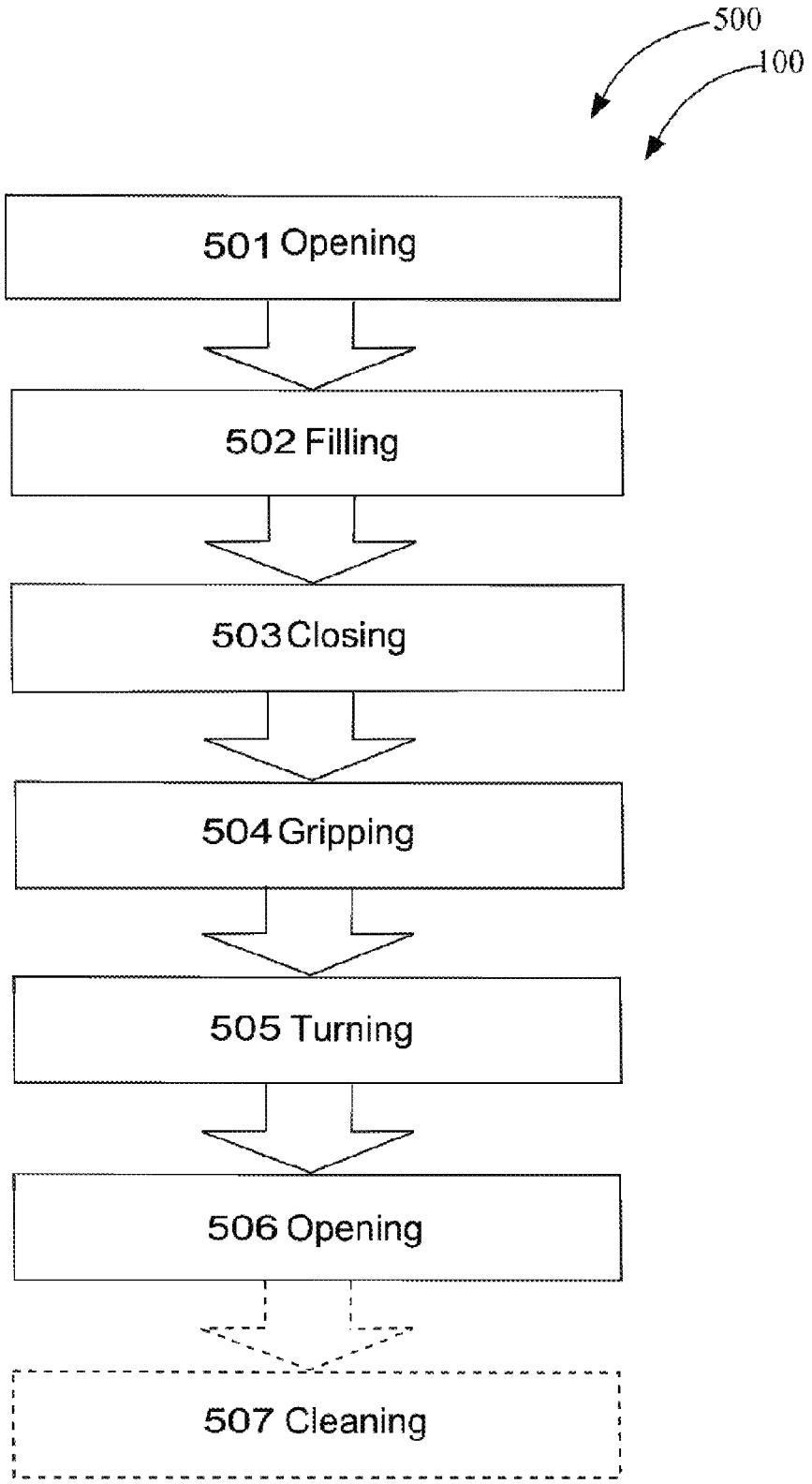
FIG. 5 is a flowchart illustrating a method of use of the crank-n-foam system according to an embodiment of the present invention of FIGS. 1-4B.

Referring now to FIG. 5, showing a flowchart illustrating a method of use 500 for crank-n-foam system 100 according to an embodiment of the present invention of FIGS. 1-4B.

Flowchart of step method of use 500 shows step one 501 opening fill port 122, step two 502 filling reservoir 115, step three 503 closing fill port 122, step four 504 gripping hand grip 108, step five 505 turning hand crank 126 rapidly, step six 506 opening chamber flap 160. The method may further comprise step seven 507 cleaning reservoir 115 as needed.

It should be noted that step 507 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A crank-n-foam system comprising:

a crank-n-foam assembly having;

a hand grip;

a reservoir having;

a fill port;

a hand crank;

a pivot rod;

an inner volume;

a reservoir shell; and a series of paddles;

a barrel having;

a manual switch;

an inner chamber;

a barrel shell; and a chamber flap;

wherein said crank-n-foam system comprises said crank-n-foam assembly;

wherein said crank-n-foam assembly comprises said hand grip, said reservoir, and said barrel in functional combination;

wherein said hand grip is suitable for gripping and holding said crank-n-foam assembly for use;

wherein said reservoir comprises said fill port, said hand crank, said pivot rod, said inner volume, said reservoir shell, and said series of paddles in combination;

wherein said pivot rod is non removably attached to said series of paddles within said inner volume;

wherein when said hand crank is turned about its axis, said series of paddles rotate in a likewise manner within said inner volume;

wherein said barrel comprises said manual switch, said inner chamber, said barrel shell, and said chamber flap in combination;

wherein said manual switch is non removably attached to said chamber flap within said inner chamber;

wherein said manual switch is able to rotate said chamber flap to close and effectively seal said inner chamber from said reservoir, as needed to build pressure in said reservoir, said inner chamber defined by said barrel shell; and wherein said crank-n-foam assembly is able to be filled with a soap product via said fill port on said reservoir, and a user is able to manually turn said hand crank in a rapid manner with said chamber flap in a closed position, thereby creating a foamy, substantially pressurized solution within said reservoir, said user is then able to turn said chamber flap to an open position, thereby dispelling bubbles and said foamy solution from said inner chamber in a rapid fashion.

2. The crank-n-foam system of claim 1 wherein said crank-n-foam assembly comprises a plastic material, which makes said crank-n-foam assembly substantially corrosion resistant.

3. The crank-n-foam system of claim 2 wherein said crank-n-foam assembly comprises a gun shaped toy.

4. The crank-n-foam system of claim 2 wherein said crank-n-foam assembly comprises a substantially waterproof material.

5. The crank-n-foam system of claim 4 wherein said crank-n-foam assembly comprises a leak proof said reservoir able to contain a substantially pressurized said soapy substance until dispelled by said user.

6. The crank-n-foam system of claim 1 wherein said series of paddles comprise a rigid, durable material able to maintain it's original shape and properties while submerged in said soapy substance for extended periods of time.

7. The crank-n-foam system of claim 6 wherein said each paddle of said series of paddles comprises holes to facilitate agitation of said soap product while rapidly turning said hand crank.

8. The crank-n-foam system of claim 5 wherein said reservoir comprises a substantially clear material to allow said user to know when agitation of said soap product is complete.

9. The crank-n-foam system of claim 7 wherein said pivot rod comprises a ferrous material for longevity of use.

10. The crank-n-foam system of claim 9 wherein said pivot rod passes through said reservoir while maintaining a leak proof condition via use of a seal.

11. The crank-n-foam system of claim 10 wherein said hand crank is non-removably attached to said pivot rod, which couples through said reservoir shell, to facilitate rotation of said series of paddles within said reservoir.

12. The crank-n-foam system of claim 11 wherein said hand crank is able to be rotated clockwise to agitate said soap product for use as needed.

13. The crank-n-foam system of claim 11 wherein said hand crank is able to be rotated counter clockwise to agitate said soap product for use as needed.

14. The crank-n-foam system of claim 1 wherein said manual switch rotates said chamber flap upwardly to dispense foam and bubbles from said inner chamber.

15. The crank-n-foam system of claim 12 wherein said hand crank is able to extend from either side of said reservoir for left- and right-handed users.

16. The crank-n-foam system of claim 1 wherein said fill port rotates counter clockwise to open said reservoir for filling, and subsequently rotates clockwise to close said fill port.

17. A crank-n-foam system comprising:

a crank-n-foam assembly having;

a hand grip;

a reservoir having;

a fill port;

a hand crank;

a pivot rod;

an inner volume;

a reservoir shell; and a series of paddles;

a barrel having;

a manual switch;

an inner chamber;

a barrel shell; and a chamber flap;

wherein said crank-n-foam system comprises said crank-n-foam assembly;

wherein said crank-n-foam assembly comprises a durable, plastic material, which makes said crank-n-foam assembly substantially corrosion resistant;

wherein said crank-n-foam assembly comprises a substantially waterproof material;

wherein said crank-n-foam assembly comprises said hand grip, said reservoir, and said barrel in functional combination;

wherein said crank-n-foam assembly comprises a gun shaped toy;

wherein said hand grip is suitable for gripping and holding said crank-n-foam assembly for use;

wherein said reservoir comprises said fill port, said hand crank, said pivot rod, said inner volume, reservoir shell, and said series of paddles in combination;

wherein said fill port rotates counter clockwise to open said reservoir for filling, and subsequently rotates clockwise to close said fill port;

wherein said crank-n-foam assembly comprises a leak proof said reservoir able to contain a substantially pressurized said soapy substance until dispelled by said user;

wherein said reservoir comprises a substantially clear material to allow said user to know when agitation of said soap product is complete;

wherein said pivot rod is non removably attached to said series of paddles within said inner volume;

wherein said pivot rod passes through said reservoir shell while maintaining a leak proof condition via use of a seal;

wherein said hand crank is non removably attached to said pivot rod, which couples through said reservoir shell, to facilitate rotation of said series of paddles within said reservoir;

wherein said hand crank is able to extend from either side of said reservoir for left and right handed users;

wherein said pivot rod comprises a durable material for longevity of use;

wherein said series of paddles comprise a rigid, durable material able to maintain it's original shape and properties while submerged in said soapy substance for extended periods of time;

wherein when said hand crank is turned about its axis, said series of paddles rotate in a likewise manner within said inner volume;

wherein said hand crank is able to be rotated clockwise to agitate said soap product for use as needed;

wherein said hand crank is able to be rotated counter clockwise to agitate said soap product for use as needed;

wherein said each paddle of said series of paddles comprises holes to facilitate agitation of said soap product while rapidly turning said hand crank;

wherein said barrel comprises said manual switch, said inner chamber, said barrel shell, and said chamber flap in combination;

wherein said manual switch is non removably attached to said chamber flap within said inner chamber;

wherein said manual switch is able to rotate said chamber flap to close and effectively seal said inner chamber from said reservoir, as needed to build pressure in said reservoir, said inner chamber defined by said barrel shell;

wherein said manual switch rotates said chamber flap upwardly to dispense foam and bubbles from said inner chamber; and wherein said crank-n-foam assembly is able to be filled with a soap product via said fill port on said reservoir, and a user is able to manually turn said hand crank in a rapid manner with said chamber flap in a closed position, thereby creating a foamy, substantially pressurized solution within said reservoir, said user is then able to turn said chamber flap to an open position, thereby dispelling bubbles and said foamy solution from said inner chamber in a rapid fashion.

18. The crank-n-foam system of claim 17 further comprising a kit including: one said crank-n-foam assembly having: one said hand grip, one said reservoir with said hand crank and said series of paddles, one said barrel with said manual switch and said chamber flap, and at least one set of user instructions for use.

* * * * *